US007131220B1

(12) United States Patent
Richey

(10) Patent No.: US 7,131,220 B1
(45) Date of Patent: Nov. 7, 2006

(54) INFLATABLE FOOTWEAR

(76) Inventor: Todd Douglas Richey, #211398 Edisto B 9, P.O. Box 205, Ridgeville, SC (US) 29472

( * ) Notice: Subject to any disclaimer, the term of this patent is extended or adjusted under 35 U.S.C. 154(b) by 0 days.

(21) Appl. No.: 10/164,801

(22) Filed: Jun. 7, 2002

(51) Int. Cl.
*A43B 7/14* (2006.01)

(52) U.S. Cl. ..... 36/93; 36/29

(58) Field of Classification Search ..... 36/93, 36/153, 10, 29
See application file for complete search history.

(56) References Cited

U.S. PATENT DOCUMENTS

| | | | | |
|---|---|---|---|---|
| 483,246 | A | | 9/1892 | Chantler |
| 2,798,311 | A | | 7/1957 | Scholl |
| 3,469,576 | A | * | 9/1969 | Smith et al. ..... 36/154 |
| 3,888,242 | A | * | 6/1975 | Harris et al. ..... 36/88 |
| 4,229,889 | A | * | 10/1980 | Petrosky ..... 36/28 |
| 4,991,317 | A | | 2/1991 | Lakic |
| 5,499,459 | A | | 3/1996 | Tomaro |
| 5,526,584 | A | | 6/1996 | Bleimhofer et al. |
| 6,006,448 | A | | 12/1999 | Hellman |
| 6,041,443 | A | | 3/2000 | Pas et al. |

FOREIGN PATENT DOCUMENTS

| | | | |
|---|---|---|---|
| DE | 3805591 | * | 8/1989 |
| EP | 237591 | * | 9/1987 |
| FR | 2622775 | * | 5/1989 |

* cited by examiner

*Primary Examiner*—Ted Kavanaugh

(57) ABSTRACT

An inflatable footwear for providing customized support for the user. The inflatable footwear includes an inner assembly with sole and upper portions and an outer assembly also having sole and upper portions, said outer assembly being coupled to said inner assembly along a annular edge and defining an interior air chamber for being inflated and supporting the foot and ankle of the user.

13 Claims, 2 Drawing Sheets

INFLATABLE FOOTWEAR

BACKGROUND OF THE INVENTION

1. Field of the Invention

The present invention relates to foot-ware devices and more particularly pertains to a new inflatable footwear for providing customized support for the user.

2. Description of the Prior Art

The use of footwear devices is known in the prior art. U.S. Pat. No. 6,006,448 describes a device using a fixed third web bubble material for the formation of footwear, but has a fixed inflation and size so as not to be customizable. Another type of footwear devices in U.S. Pat. No. 5,526,584 having a plastic film for producing a waterproof sole for a sock-like insert.

While these devices fulfill their respective, particular objectives and requirements, the need remains for a device that has certain improved features including by way of illustration and not limitation, customizable support for the entire foot of the user, and customizable sizing.

SUMMARY OF THE INVENTION

The present invention meets the needs presented above by providing a custom inflatable interior air chamber for providing a user defined level of support for the foot of the user.

An object of the present invention is to provide a new inflatable footwear that may be worn alone or in conjunction with conventional shoes or boots.

To this end, the present invention generally comprises an inflatable footwear for providing customized support for the user. The inflatable footwear includes an inner assembly with sole and upper portions and an outer assembly also having sole and upper portions, said outer assembly being coupled to said inner assembly along a annular edge and defining an interior air chamber for being inflated and supporting the foot and ankle of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
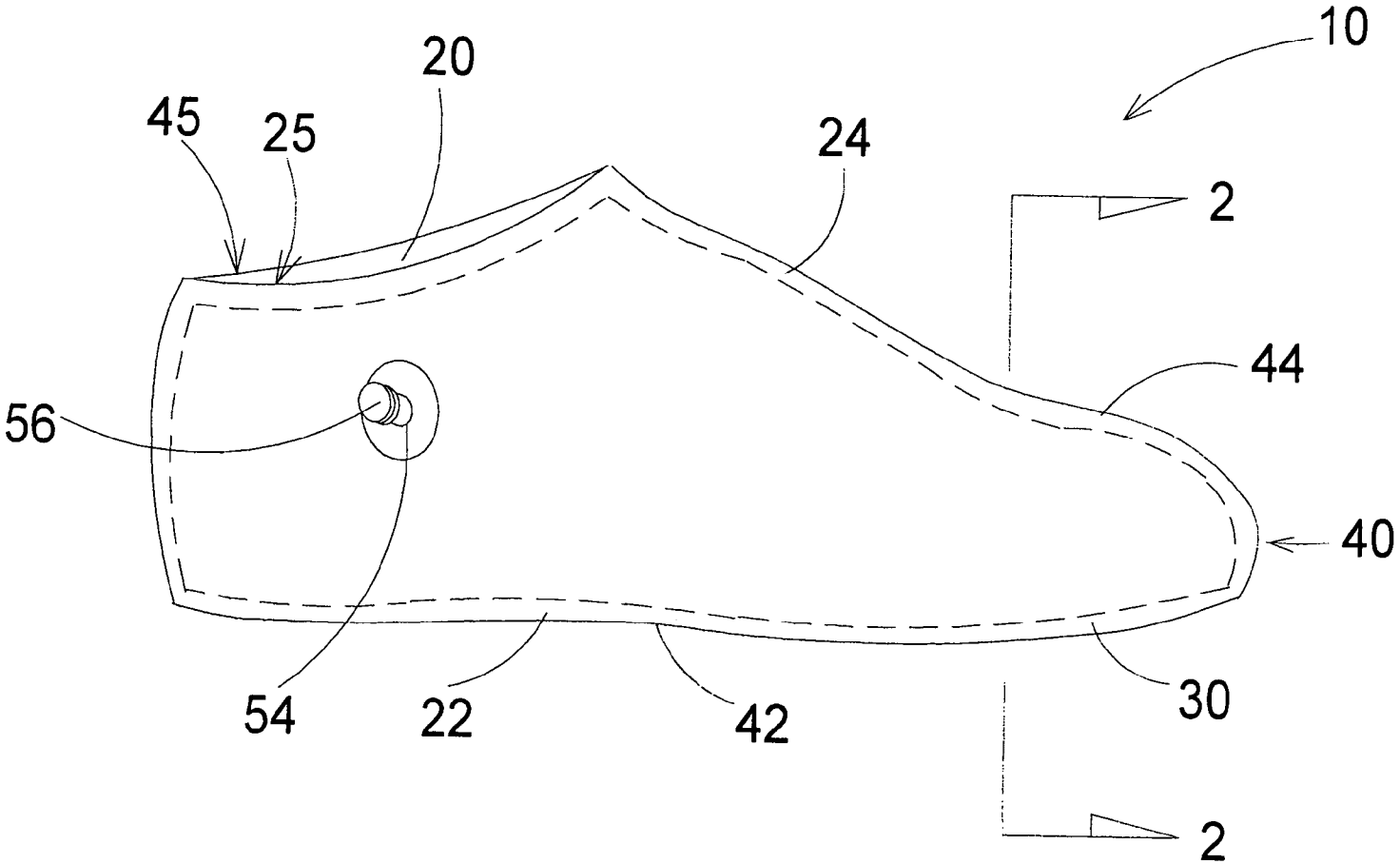
FIG. 1 is a schematic perspective view of a new inflatable footwear according to the present invention.
Figure 2:
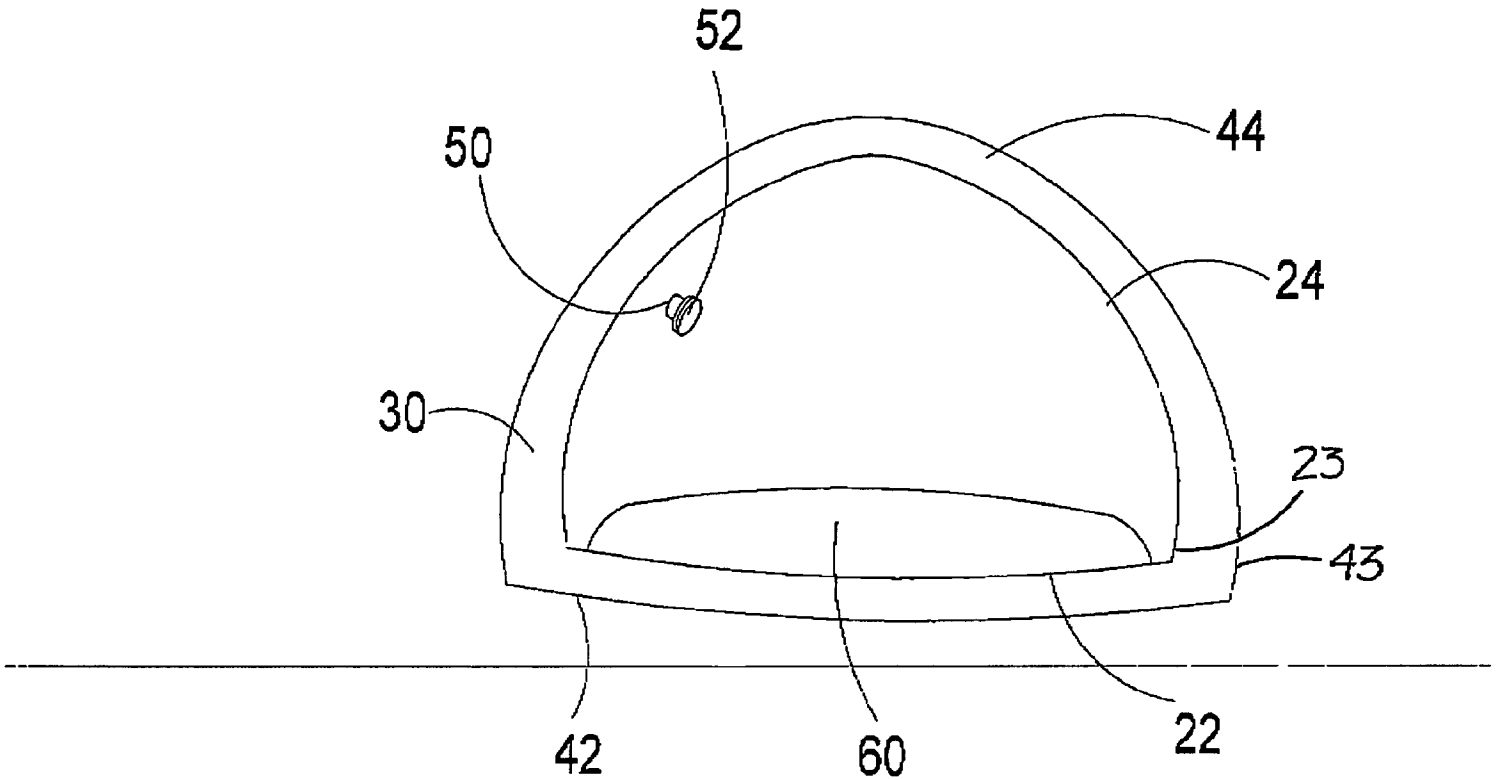
FIG. 2 is a schematic cross-sectional view of the present invention taken along line 2—2 of FIG. 1.

With reference now to the drawings, and in particular to FIGS. 1 through 2 thereof, a new inflatable footwear embodying the principles and concepts of the present invention and generally designated by the reference numeral 10 will be described.

As best illustrated in FIGS. 1 through 2, the inflatable footwear 10 generally comprises an inner assembly 20 and an outer assembly 40.

The inner assembly 20 includes a sole portion 22 and an upper portion 24. The sole portion 22 includes a perimeter edge 23. The upper portion 24 is coupled to the sole portion 22 along the perimeter edge 23. The upper portion 24 includes an annular edge 25 for receiving a foot and ankle of the user. The inner assembly 20 includes an overall length and an overall width.

The outer assembly 40 includes an outer sole portion 42 and an outer upper portion 44. The outer sole portion 42 includes an outer perimeter edge 43. The outer upper portion 44 includes an outer annular edge 45 being for receiving a foot and ankle of the user. The outer assembly 40 includes an outer overall length and outer overall width. The outer overall length is greater than the overall length of the inner assembly 20. The outer overall width is greater than the overall width of the inner assembly 20. The outer assembly 40 is coupled to the inner assembly 20 along the annular edge 25,45.

The inner 20 and outer assemblies 40 define an interior air chamber 30. The interior air chamber 30 is inflatable for supporting the foot of the user.

In a preferred embodiment, the inner assembly 20 further comprises an aperture 50 and a valve assembly 52. The aperture 50 extends through the upper portion 24 and includes a perimeter edge. The valve assembly 52 is coupled to the upper portion 24 along the perimeter edge of the aperture 50. The valve assembly 52 is for inflating the interior air chamber 30. The valve assembly 52 is positionable within the interior air chamber 30 when not is used. The valve assembly 52 is positionable to extend from the upper portion 24 when is used to change an inflation of the interior air chamber 30.

In an alternate embodiment, the outer assembly 40 further comprises and aperture 54 and a valve assembly 56. The aperture 54 extends through the outer upper portion 44. The aperture 54 includes a perimeter edge. The valve assembly 56 is coupled to the outer upper portion 44 along the perimeter edge of the aperture 54. The valve assembly 56 is for inflating the interior air chamber 30. The valve assembly 56 is positionable within the interior air chamber 30 when not is used. The valve assembly 56 is positionable to extend from the outer upper portion 44 when is used to change an inflation of the interior air chamber 30.

In a further embodiment, the inner assembly 20 further comprises a support member 60 coupled to the sole portion 22. The support member 60 provides arch support for the foot of the user. The arch support 60 is designed for abutting an arch portion of the foot of the user.

In still a further embodiment, the interior air chamber 30 is inflatable such that ¼ to 1 inch of air supports and separated the inner assembly 20 from the outer assembly 40 along the sole portion 22 and the outer sole portions 42. The outer assembly 40 is separated from the inner assembly 20 by the interior air chamber 30 except along the annular edge 25,45.

In yet a further embodiment, the outer assembly 40 comprises an elastomeric material, which is substantially gas impermeable. Similarly, the inner assembly 20 also comprises an elastomeric material is substantially gas impermeable such that the interior air chamber 30 maintains inflation during use.

In use, the inflatable footwear device is placed on the foot of the user. The user then inflates the device to the desired level of support. The device may be worn alone or in conjunction with conventional shoes or boots.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable footwear device comprising:

an inner assembly having a sole portion and an upper portion, said sole portion having a perimeter edge, said upper portion being coupled to said sole portion along said perimeter edge, said upper portion having an annular edge adapted for receiving a foot and ankle of the user, said inner assembly having an overall length and an overall width, said inner assembly defining an interior for receiving the foot;

an outer assembly having an outer sole portion and an outer upper portion, said outer sole portion having an outer perimeter edge, said outer upper portion having an outer annular edge adapted for receiving a foot and ankle of the user, said outer assembly having an outer overall length and outer overall width, said outer overall length being greater than said overall length of said inner assembly, said outer overall width being greater than said overall width of said inner assembly, said outer assembly being coupled to said inner assembly along said annular edge;

said inner and outer assemblies defining an interior air chamber, said interior air chamber being inflatable for supporting the foot of the user, said interior air chamber extending between the sole portion of said inner assembly and the outer sole portion of said outer assembly such that the air chamber extends between a foot when positioned in said interior and a ground surface when the foot is walking;

wherein said inner assembly further comprises a support member coupled to the sole portion of said inner assembly, said support member being positioned in the interior of said inner assembly such that the interior air chamber extends between said support member and the outer sole portion of said outer assembly, said support member providing an arch support for the foot of the user for abutting an arch portion of the foot of the user.

2. The device of claim 1, wherein said inner assembly further comprises:

an aperture extending through said upper portion, said aperture having a perimeter edge;

a valve assembly coupled to said upper portion along said perimeter edge of said aperture, said valve assembly being for inflating said interior air chamber, said valve assembly being positionable within said interior air chamber when not being used, said valve assembly being positionable to extend from said upper portion when being used to change an inflation of said interior air chamber.

3. The device of claim 1, wherein said outer assembly further comprises:

an aperture extending through said outer upper portion, said aperture having a perimeter edge;

a valve assembly coupled to said outer upper portion along said perimeter edge of said aperture, said valve assembly being for inflating said interior air chamber, said valve assembly being positionable within said interior air chamber when not being used, said valve assembly being positionable to extend from said outer upper portion when being used to change an inflation of said interior air chamber.

4. The device of claim 1, wherein said support member includes an upper surface, said upper surface of said support member being smooth.

5. The device of claim 1, wherein said interior air chamber being inflatable such that ¼ to 1 inch of air supports and separates said inner assembly from said outer assembly along said sole portion and said outer sole portions, said outer assembly being separated from said inner assembly by said interior air chamber except along said annular edge.

6. The device of claim 1, wherein said outer assembly comprises an elastomeric material being substantially gas impermeable, said inner assembly comprises an elastomeric material being substantially gas impermeable such that said interior air chamber maintains inflation during use.

7. An inflatable footwear device comprising:

an inner assembly having a sole portion and an upper portion, said sole portion having a perimeter edge, said upper portion being coupled to said sole portion along said perimeter edge, said upper portion having an annular edge adapted for receiving a foot and ankle of the user, said inner assembly having an overall length and an overall width, said inner assembly defining an interior for receiving the foot;

an outer assembly having an outer sole portion and an outer upper portion, said outer sole portion having an outer perimeter edge, said outer upper portion having an outer annular edge adapted for receiving a foot and ankle of the user, said outer assembly having an outer overall length and outer overall width, said outer overall length being greater than said overall length of said inner assembly, said outer overall width being greater than said overall width of said inner assembly, said outer assembly being coupled to said inner assembly along said annular edge;

said inner and outer assemblies defining an interior air chamber, said interior air chamber being inflatable for supporting the foot of the user, said interior air chamber extending between the sole portion of said inner assembly and the outer sole portion of said outer assembly such that the air chamber extends between a foot when positioned in said interior and a ground surface when the foot is walking;

wherein said inner assembly further comprises a support member coupled to the sole portion of said inner assembly, said support member being positioned in the interior of said inner assembly such that the interior air chamber extends between said support member and the outer sole portion of said outer assembly, said support member providing an arch support for the foot of the user for abutting an arch portion of the foot of the user;

an aperture extending through said upper portion, said aperture having a perimeter edge;

a valve assembly coupled to said upper portion of said inner assembly along said perimeter edge of said aperture, said valve assembly being for inflating said interior air chamber, said valve assembly being positionable within said interior air chamber when not being used, said valve assembly being positionable to extend from said upper portion when being used to change an inflation of said interior air chamber.

8. The device of claim 7, wherein said support member includes an upper surface, said upper surface of said support member being smooth.

9. The device of claim 7, wherein said interior air chamber being inflatable such that ¼ to 1 inch of air supports and separated said inner assembly from said outer assembly along said sole portion and said outer sole portions, said outer assembly being separated from said inner assembly by said interior air chamber except along said annular edge.

10. The device of claim 7 wherein said support member is confined to the sole portion of said inner assembly and does no extend to the upper portion of said inner assembly.

11. An inflatable footwear device comprising:

an inner assembly having a sole portion and an upper portion, said sole portion having a perimeter edge, said upper portion being coupled to said sole portion along said perimeter edge, said upper portion having an annular edge adapted for receiving a foot and ankle of the user, said inner assembly having an overall length and an overall width;

an outer assembly having an outer sole portion and an outer upper portion, said outer sole portion having an outer perimeter edge, said outer upper portion having an outer annular edge adapted for receiving a foot and ankle of the user, said outer assembly having an outer overall length and outer overall width, said outer overall length being greater than said overall length of said inner assembly, said outer overall width being greater than said overall width of said inner assembly, said outer assembly being coupled to said inner assembly along said annular edge;

said inner and outer assemblies defining an interior air chamber, said interior air chamber being inflatable for supporting the foot of the user, said interior air chamber extending between the sole portion of said inner assembly and the outer sole portion of said outer assembly such that the air chamber extends between a foot when positioned in said interior and a ground surface when the foot is walking;

wherein said inner assembly further comprises a support member coupled to the sole portion of said inner assembly, said support member being positioned in the interior of said inner assembly such that the interior air chamber extends between said support member and the outer sole portion of said outer assembly said support member providing an arch support for the foot of the user for abutting an arch portion of the foot of the user;

an aperture extending through said outer upper portion, said aperture having a perimeter edge;

a valve assembly coupled to said outer upper portion along said perimeter edge of said aperture, said valve assembly being for inflating said interior air chamber, said valve assembly being positionable within said interior air chamber when not being used, said valve assembly being positionable to extend from said outer upper portion when being used to change an inflation of said interior air chamber;

wherein said support member includes an upper surface, said upper surface of said support member being smooth; and wherein said support member is confined to the sole portion of said inner assembly and does not extend to the upper portion of said inner assembly.

12. The device of claim 11, wherein said interior air chamber being inflatable such that ¼ to 1 inch of air supports and separated said inner assembly from said outer assembly along said sole portion and said outer sole portions, said outer assembly being separated from said inner assembly by said interior air chamber except along said annular edge.

13. The device of claim 1 wherein said support member is confined to the sole portion of said inner assembly and does not extend to the upper portion of said inner assembly.

* * * * *